United States Patent [19]

Outlaw et al.

[11] Patent Number: 4,830,372

[45] Date of Patent: May 16, 1989

[54] BATTING PRACTICE DEVICE

[75] Inventors: James F. Outlaw, 1701 Victoria Station Dr., Apt. 803, Victoria, Tex. 77901; Aaron L. Lucius, Montalba, Tex.

[73] Assignee: James F. Outlaw, Victoria, Tex.

[21] Appl. No.: 42,389

[22] Filed: Apr. 24, 1987

[51] Int. Cl.[4] ..... A63B 69/40

[52] U.S. Cl. ..... 273/26 R; 273/29 A; 124/50

[58] Field of Search ..... 273/30, 26 D, 29 A, 273/26 R, 6, 395, 340

[56] References Cited

U.S. PATENT DOCUMENTS

| | | | |
|---|---|---|---|
| 3,659,576 | 5/1972 | Eade | 273/26 D |
| 3,672,672 | 6/1972 | Rubin | 273/26 A |
| 3,915,143 | 10/1975 | Waller | 273/26 D |
| 3,963,240 | 6/1976 | Tidwell | 273/26 A |
| 3,999,753 | 12/1976 | Desilets et al. | 273/26 D |
| 4,021,036 | 5/1977 | Nelson et al. | 273/29 A |
| 4,027,878 | 6/1977 | Daddeh | 273/6 |
| 4,402,507 | 9/1983 | Hudson | 273/26 D |
| 4,538,810 | 10/1985 | Brophy | 273/26 D |
| 4,548,407 | 10/1985 | Sato | 273/26 D |

FOREIGN PATENT DOCUMENTS

| | | | |
|---|---|---|---|
| 218407 | 11/1961 | Australia | 273/340 |
| 3339622 | 6/1984 | Fed. Rep. of Germany | 273/29 A |
| 1180019 | 9/1985 | Fed. Rep. of Germany | 273/29 A |
| 12824 | of 1902 | United Kingdom | 273/340 |
| 926492 | 5/1963 | United Kingdom | 273/26 R |

*Primary Examiner*—Richard C. Pinkham
*Assistant Examiner*—T. Brown
*Attorney, Agent, or Firm*—Richard J. Smith

[57] ABSTRACT

A device for practicing the motor skills associated with striking a moving ball. A series of balls are successively released from a ball magazine and deflected into a batter's hitting zone. Apparatus is provided for predetermining the approximate post deflection trajectory of each ball, thereby selectively positioning each ball within the batter's hitting zone. A timing feature for signaling deflection of the ball is also disclosed.

13 Claims, 5 Drawing Sheets

BATTING PRACTICE DEVICE

BACKGROUND OF THE INVENTION

The present invention relates to a batting practice device including apparatus for selectively controlling the trajectory of a deflected ball within the batter's hitting zone.

Various types of devices have heretofore been designed to enable a batter to practice the skills associated with striking a moving ball with a bat. Devices employing a moving ball can be placed into two categories. The first category of devices includes devices known as "pitching machines." Pitching machines pitch or hurl a ball through the batters hitting zone in a trajectory similar to that which would be achieved by a live pitcher. Utilization of a pitching machine device obviously requires the demanding skill of timing the arrival of the ball as it approaches the batter's hitting zone. The present invention allows the batter to practice the motor skills associated with striking a moving ball without requiring the use of the skills associated with timing the arrival of the ball as it approaches the batter's hitting zone.

The second category of devices includes devices that have become known as "toss" or "soft toss" machines. Toss or soft toss devices simulate the flight of a ball that has been delivered into the batter's hitting zone by a gentle underhand toss. Examples of such toss type devices are illustrated in U.S. Pat. Nos. 4,548,407 issued to Sato and 4,538,810 issued to Brophy. U.S. Pat. No. 4,548,407 discloses a toss batting trainer including a ball tosser positioned below the discharge end of a track feeder for deflecting each ball discharged from the feeder. U.S. Pat. No. 4,538,810 discloses a baseball dispensing device for batting practice including a spring adapted to propel a ball vertically upward. Utilization of a toss type device generally requires some means of protecting the device from a batted ball, such as a screen, if the device is positioned in the same relative direction to the batter as would be occupied by a pitcher. When convenience and economic practicality necessitate the use of a toss type device in a position where it is removed from the line of flight of a normally batted ball, the ball must then enter the batter's hitting zone from an unrealistic direction. Regardless of the relative positioning of the toss device and the batter and the low velocity of the ball from the toss device, the batter is still required to use the skills associated with tracking and timing the ball as it approaches and enters the batter's hitting zone.

The present invention allows a batter to practice the skills associated with hitting a ball at various locations within the hitting zone while only requiring the batter to visually intercept the ball at a point within the hitting zone. That is, the present invention does not require a batter to utilize the skills of visually tracking and timing a ball as it approaches the hitting zone. The present invention also allows a batter to practice hitting balls successively directed to various locations in the hitting zone without requiring an adjustment in the relative positioning of the batter and the batting practice device.

SUMMARY OF THE INVENTION

The present invention provides a device for the practice of batting a series of balls which includes a trajectory control apparatus for successively directing deflected balls to preselected positions within the batter's hitting zone. The present invention also provides an adjustable timing feature which includes apparatus for signaling the deflection of the ball.

The batting practice device of the present invention comprises a ball magazine and associated ball release mechanism supported on a substantially vertical support post above an apparatus for deflecting a ball discharged from the ball magazine. The ball release magazine is designed to allow the lowermost ball within the magazine to fall therefrom while retaining the remaining balls within the magazine. The ball deflection apparatus comprises a flexible surface centrally positioned beneath the discharge port of the magazine.

The trajectory control apparatus of the present invention comprises a rotatable support arm which is positioned beneath the flexible surface and which has an arcuate trajectory controller associated therewith. Apparatus is provided for varying the distance between the underside of the flexible surface and the trajectory controller. Apparatus is also provided for rotating the support arm to thereby further vary the position of the trajectory controller relative to the flexible surface. An auditory signalling apparatus, such as a bell, is secured to the flexible surface to signal the deflection of the ball.

Prior to usage of the batting practice device, a plurality of balls are inserted into the ball magazine and the approximate post deflection trajectory of the lowermost ball is predetermined by rotating the support arm to the desired position and raising or lowering the trajectory controller relative to the underside of the flexible surface. When the lowermost ball is thereafter discharged from the magazine it will strike the flexible surface and be deflected upward in approximately the predetermined post deflection trajectory. When the ball strikes the flexible surface, the bell rings, thereby signaling to the batter that a ball would have been released by a pitcher in a visually imagined frame of reference. The batter will normally begin swinging at the ball when it reaches approximately the apex of its post deflection trajectory, and thereafter make contact with the ball slightly below the apex of the post deflection trajectory.

DETAILED DESCRIPTION OF THE PREFERRED EMBODIMENT

Figure 1:
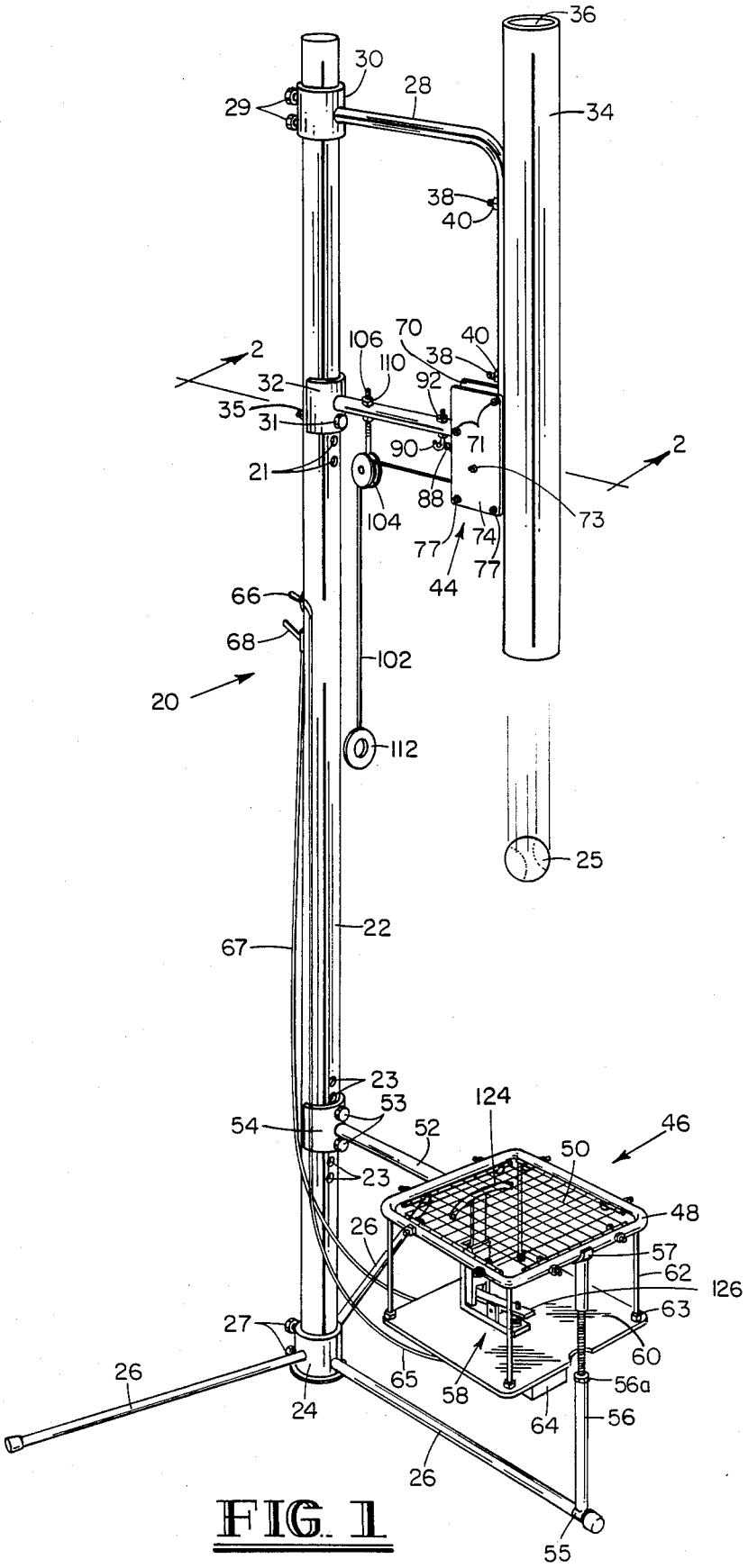
FIG. 1 is a perspective view of the preferred embodiment of the batting practice device of the present invention.

Referring to FIG. 1, the preferred embodiment of the batting practice device of the present invention is identified by the number 20. The batting practice device 20 comprises a cylindrical support post 22 which is received within a sleeve-type base 24 having a plurality of legs 26 connected thereto. Base 24 and legs 26 form a tripod stand for supporting post 22. Post 22 is secured within base 24 by a pair of pressure bolts 27 which are threaded through base 24 and abut against post 22. The batting practice device 20 further comprises a U-shaped support arm 28 which is connected on an uppermost end thereof to uppermost sleeve 30 and on a lowermost end thereof to intermediate sleeve 32. Post 22 is received through the passage within sleeve 30 and within the arcuate groove within sleeve 32. Sleeve 30 is adjustably secured to post 22 by a pair of pressure bolts 29 which are threaded through sleeve 30 and abut against post 22. Further, sleeve 32 is adjustably connected to post 22 by means of a bolt 31 which is inserted through a hole 33 (illustrated in FIG. 2) in sleeve 32 and one of a plurality of passages 21 in post 22 and secured by a nut 35. Bolts 29, bolt 31, nut 35, hole 33, and passages 21 permit variable adjustment of the height or vertical position of arm 28 along post 22.

Figure 2:
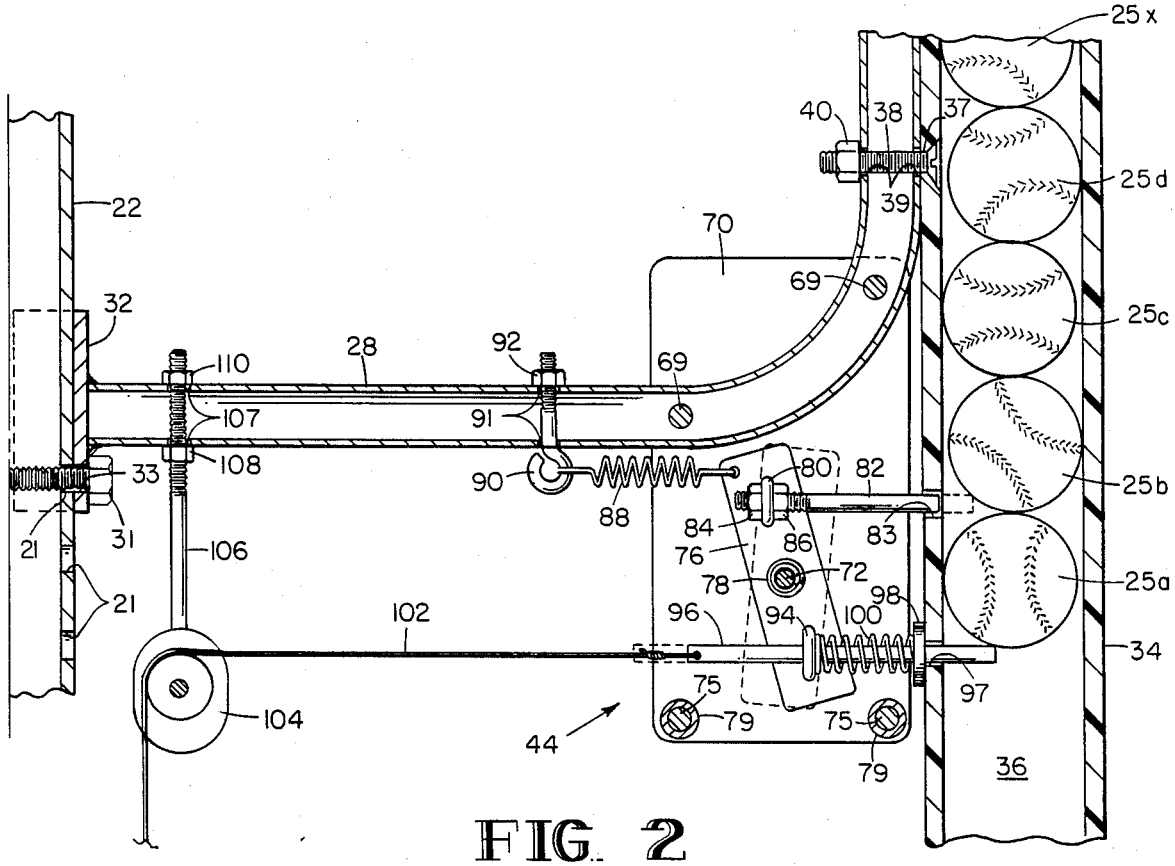
FIG. 2 is a cutaway cross sectional view taken along section lines 2—2 of FIG. 1 illustrating the preferred embodiment of the ball release mechanism of the present invention.

Referring to FIG. 1 and FIG. 2, the batting practice device 20 further comprises a cylindrical ball magazine 34 having a passage 36 therethrough. Magazine 34 is preferably connected to support arm 28 by a pair of bolts 38 which are inserted through aligned passages 37 and 39 in magazine 34 and support arm 28, respectively, and secured by a pair of nuts 40. Holes (not shown) may also be provided in the outer portion of magazine 34 opposite passages 37 to facilitate securement of bolts 38 and nuts 40. Magazine 34 may be raised or lowered by raising or lowering arm 28 along post 22. The batting practice device 20 is further provided with a ball release mechanism 44 which is associated with magazine 34 and is designed to allow a ball 25 to be released from magazine 34.

Referring again to FIG. 1, the batting practice device 20 further comprises ball deflection apparatus 46 comprising a frame 48 having a resilient or flexible material connected thereto, such as a net 50. Net 50 is preferably knotless nylon netting. However, another type of resilient material capable of deflecting a dropped ball 25, such as a piece of rubber, may be secured to frame 48 in place of net 50. Frame 48 is connected to a lowermost support arm 52 which is connected to a lowermost sleeve 54. Post 22 is received within the arcuate groove within sleeve 54. Further, sleeve 54 is adjustably connected to post 22 by means of a pair of bolts 53, each of which is inserted through one of a pair of holes in sleeve 54 and one of a plurality of passages 23 in post 22 and secured by a nut 55 (illustrated in FIG. 6), thereby permitting variable adjustment of the height or vertical position of arm 52, frame 48, and net 50 along support post 22. Device 20 also includes an adjustable jacking post 56 having a quarter sleeve 55 on the lowermost end thereof, a quarter sleeve 57 on the uppermost end thereof, and a locking nut 56*a* on the threaded portion thereof. A leg 26 is received within sleeve 55 while frame 48 is received within sleeve 37. Post 56 is utilized to support frame 48 and maintain frame 48 and net 50 in a substantially level position.

Figure 5:
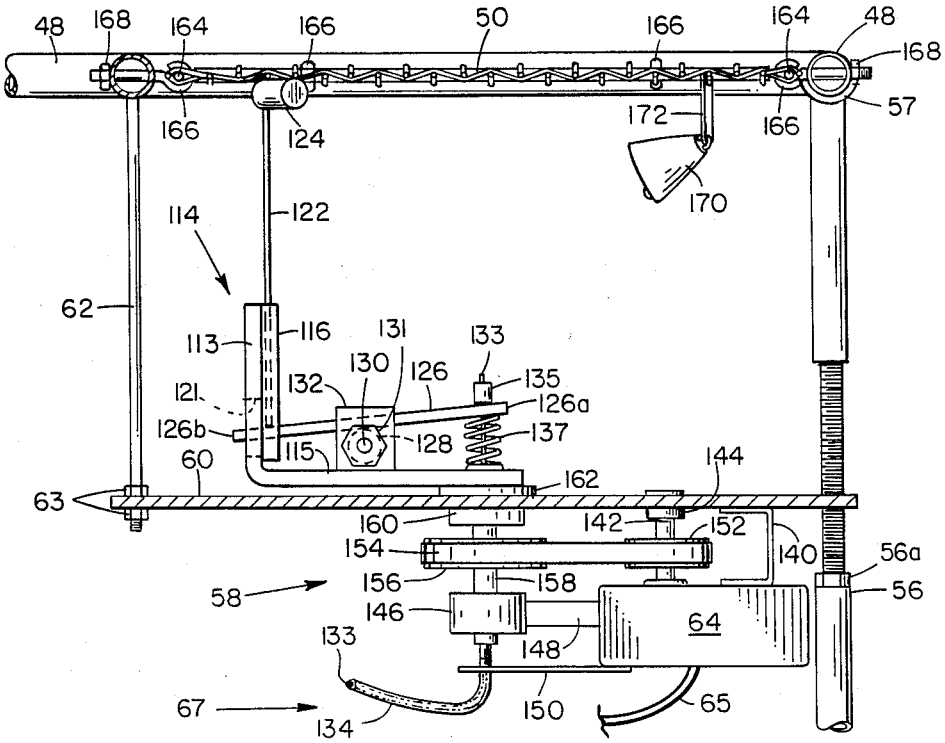
FIG. 5 is a cross sectional view taken along section lines 5—5 of FIG. 4 illustrating the preferred embodiment of the ball deflection apparatus and trajectory control apparatus of the present invention.

Referring to FIG. 1 and FIG. 5, the batting practice device 20 further comprises trajectory control apparatus 58. The trajectory control apparatus 58 is supported by a base 60 which is connected to frame 48 by a plurality of support arms or hanger rods 62. The uppermost end of each rod 62 is screwed into tapped threads in frame 48 while the lowermost end of each rod 62 is inserted through a passage in base 60 and secured to base 60 by nuts 63 threaded on each rod 62 on each side of base 60, thereby permitting variable adjustment of the position of base 60 relative to frame 48. The trajectory control apparatus 58 includes a reversible electric motor 64 which is controlled by a toggle switch 66 which is screw mounted to post 22. An electrical wire 65 runs between and is connected to motor 64 and switch 66. The trajectory control apparatus 58 further includes a height adjustment lever 68 which is screw mounted to post 22. A sheathed cable 67 runs between and is connected to a rocker arm 126 and lever 68.

Referring to FIG. 1 and FIG. 2, the ball release mechanism 44 will be described in greater detail. A rearward mounting plate 70 is appropriately connected to support arm 28 by means of bolts 69, each of which extend through a hole in plate 70 and a passage in arm 28. Bolts 69 each extend through a hole in a forward mounting plate 74 and are secured thereto by nuts 71. A bolt 72, defining a pivot shaft, extends through a hole in rear mounting plate 70 and a hole in forward mounting plate 74, and is secured thereto by a nut 73. A pair of bolts 75 each extend through a hole in plate 70 and a hole in plate 74 and are each secured thereto by nuts 77. Spacers 79 are positioned about each bolt 75 intermediate plate 70 and plate 74.

Referring again to FIG. 2, shaft 72 extends through a hole in a pivot arm 76 which is rotatable on shaft 72. Arm 76 is mounted on pivot shaft 72 intermediate a fixed shaft collar (not shown) and a pivot shaft spring 78. The fixed shaft collar is secured to pivot shaft 72 by a set screw. Spring 78 is positioned about shaft 72 intermediate pivot arm 76 and forward plate 74. A washer (not shown) is preferably positioned about shaft 72 intermediate spring 78 and arm 76. A first eyelet 80 is screwed into tapped threads in the uppermost end of pivot arm 76 so as to permit eyelet 80 to swivel slightly. A cylindrical ball arrest shaft 82 extends through the passage in eyelet 80 and is secured to pivot arm 76 by means of nuts 84 and 86 which are secured to the threaded end of shaft 82 on opposite sides of first eyelet 80. The opposite end of shaft 82 extends into a passage 83 in magazine 34. A spring 88 is appropriately connected on one end thereof to the uppermost end of pivot arm 76 and on the opposite end thereof to an eye bolt 90. Eye bolt 90 is inserted through a passage 91 in arm 28 and secured thereto by a nut 92.

Referring again to FIG. 2, a second eyelet 94 is screwed into tapped threads in the lowermost end of pivot arm 76 so as to permit eyelet 94 to swivel slightly. A cylindrical ball release shaft 96 extends through the passage in eyelet 94 and through a passage 97 in magazine 34. A stop or shaft collar 98 is appropriately connected to ball release shaft 96 by a set screw and spring 100 is positioned about shaft 96 intermediate eyelet 94 and collar 98. The diameter of collar 98 is larger than the diameter of passage 97 so as to restrict movement of shaft 96 into passage 36 beyond the extent illustrated in FIG. 2. A cable 102 is connected to one end of shaft 96 and positioned about a pulley 104. Pulley 104 is connected to a pulley rod 106 which extends through a passage 107 in arm 28 and is secured thereto by nuts 108 and 110. As illustrated in FIG. 1, a ring 112 may be connected to the lowermost end of cable 102.

Referring to FIG. 2, the operation of the ball release mechanism 44 will be described in greater detail. Prior to usage of the batting practice device 20, a plurality of balls 25*a*–25*x* are inserted through the uppermost end of magazine 34 into magazine passage 36. In its rest position, illustrated in FIG. 2, pivot arm 76 will normally be pivoted about shaft 72 due to the biasing action of spring 88. Further, when arm 76 is in the rest position, shaft 96 will be substantially inserted through passage 97 into passage 36 so as to abut lowermost ball 25*a* and impede the downward movement of the column of balls 25*a*–25*x* within passage 36. However, when the ring 112 and cable 102 is pulled downward, pivot arm 76, shaft 82, and shaft 96 will assume the discharge position illustrated by the dashed lines in FIG. 2. That is, when shaft 96 is pulled away from magazine 34, collar 98 will compress spring 100 against eyelet 94, thereby causing pivot arm 76 to rotate to the discharge position illustrated by the dashed lines in FIG. 2. In this discharge position, shaft 96 is withdrawn from passage 36 so as to allow the lowermost ball 25*a* to fall by gravity through passage 36 and outward from the lowermost end of magazine 34. Further, in the discharge position illustrated by the dashed lines in FIG. 2, ball arrest shaft 82 will be inserted through passage 83 into passage 36 so as to abut the next successive ball 25*b* and impede the further downward movement of the remaining column of balls 25*b*–25*x*. However, when cable 102 is released, the biasing section of spring 88 will return the ball release mechanism 44 to the rest position, thereby withdrawing ball arrest shaft 82 from passage 36 and allowing the remaining column of balls 25*b*–25*x* to fall downward in passage 36 until the next successive ball 25*b* abuts shaft 96. The foregoing discharge procedure may thereafter be repeated for each successive ball 25*b*–25*x*.

Figure 3:
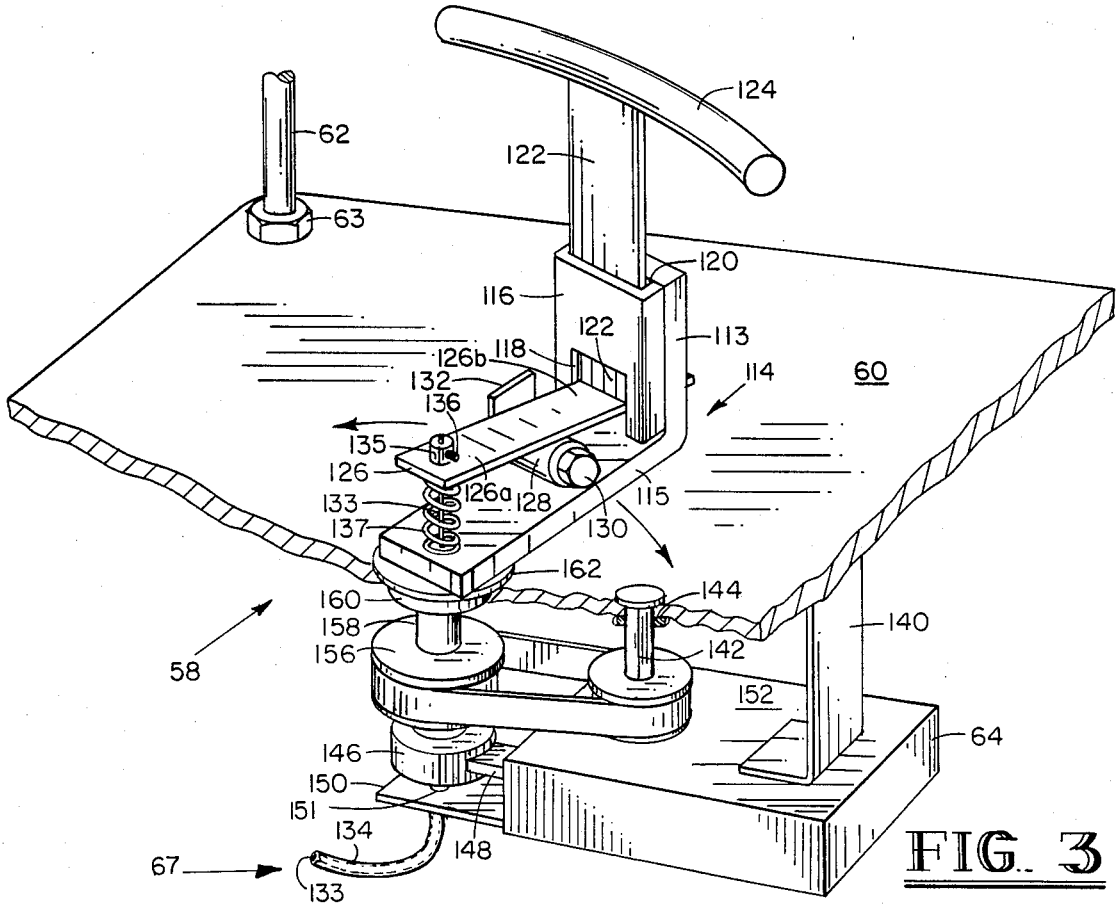
FIG. 3 is a cutaway perspective view illustrating the preferred embodiment of the trajectory control apparatus of the present invention.

Referring to FIG. 3 and FIG. 5, the trajectory control apparatus 58 will be described in greater detail. A rotatable, angular support arm 114 is positioned above base 60. A guide sheath 116 is welded or otherwise appropriately connected to the substantially vertical portion 113 of arm 114. Sheath 116 has a groove or cutout 118 therein and a passage 120 therethrough. Arm portion 113 also has a passage 121 therethrough in alignment with cutout 118. A trajectory controller post 122 is received within passage 120 and has a trajectory controller member 124 welded or otherwise appropriately connected to the uppermost end thereof. Member 124 is preferably an arcuate, cylindrical piece of metal having a diameter of approximately one half inch (½") and an arc of approximately one hundred thirty degrees (130°). Member 124 is aligned substantially parallel to net 50 and is rotatable in a circular path having a diameter of approximately five inches (5").

Referring again to FIG. 3 and FIG. 5, end 126*b* of a lever or rocker arm 126 is received within cutout 118 and through passage 121 in abutting relation with the lowermost end of post 122. Rocker arm 126 is welded to a rotational pivot or cylindrical bushing 128 which is mounted on a shaft 130. Shaft 130 is preferably a bolt which extends freely through a passage in pivot member 128. The diameter of the head of bolt 130 is larger than the diameter of the passage through pivot member 128. Bolt 130 is in threaded engagement with tapped threads in a mounting bracket 132 and secured thereto by a nut 131. Bracket 132 is preferably welded to substantially horizontal arm portion 115 of support arm 114. Cable 67 comprises a metal wire 133 having a sheath 134 surrounding a portion thereof. Wire 133 extends through a passage in rocker arm 125 and a passage in arm portion 115. Wire 133 extends through a shaft collar 135 and is secured thereto by a set screw 136 which is tightened against the wire 133. Wire 133 is therefore connected on one end thereof to arm 126 and on the other end thereof to lever 68. A spring 137 is positioned about wire 133 intermediate arm 126 and arm portion 115.

Referring again to FIG. 3 and FIG. 5, the trajectory control apparatus 58 will be described in greater detail. Reversible electric motor 64 is secured to the underside of base 60 by means of a support bracket 140 which is welded or screwed to base 60 and motor 64. Motor 64 is in operative engagement with a motor drive shaft 142. Shaft 142 is received within a first alignment bushing 144 which is welded to the underside of base 60. A second alignment bushing 146 is connected to motor 64 by a bracket 148 which is welded or screwed to bushing 146 and motor 64. A positioning clamp 150 is also welded or otherwise connected to motor 64 and has a passage 151 therethrough for receiving cable 67. Cable 67 fits snugly within passage 151 so as to hold sheath 134 stationary while allowing movement of wire 133.

Referring again to FIG. 3 and FIG. 5, motor drive shaft 142 is connected to first belt type pulley 152 by a set screw (not shown). A pulley drive belt 154 is positioned about first pulley 152 and a second belt type pulley 156. Second pulley 156 is connected to a rotational shaft 158 by a set screw (not shown). Shaft 158 extends through bushing 146. Shaft 158 also extends through a guide bushing 160, a passage in base 60, and a bushing 162, and is connected to substantially horizontal portion 115 of arm 114. Shaft 158 is received within a pocket in arm portion 115 and welded thereto. The pocket in arm portion 115 is aligned with the passage in arm portion 115 through which wire 133 extends. Rotation of shaft 142 by motor 64 will rotate pulley 152, thereby effectuating rotation of belt 154. Rotation of belt 154 will rotate pulley 156, thereby effectuating rotation of shaft 158. Rotation of shaft 158 will rotate arm 114 and controller member 124. Bushings 160 and 162 are preferably welded to base 60. Bushing 162 provides a bearing surface for the rotation of arm 114. Shaft 158 has a passage therethrough within which to receive wire 133. Sheath 134 preferably extends from lever 68 to the bottom of shaft 158.

Referring again to FIG. 3 and FIG. 5, operation of the trajectory control apparatus 58 will be described in greater detail. The trajectory controller member 124 may be raised or lowered relative to net 50 and base 60 by means of lever 68. Upward movement of lever 68 will cause wire 133 to pull downward on end 126*a* of rocker arm 126, thereby causing the opposite end 126*b* of lever arm 126 to urge post 122 upward. Downward movement of lever 68 releases the tension on wire 133 and allows spring 136 to urge end 126*a* of lever arm 126 upward, thereby allowing the opposite end 126*b* of lever arm 126 to move downward. Downward movement of end 126*b* of arm 126 allows post 122 and controller 124 to be lowered by gravity. Operation of the toggle switch 66 will activate motor 64, thereby causing shaft 142, shaft 158, and support arm 114 to rotate in a clockwise or counterclockwise direction, as illustrated by the arrows in FIG. 3. Accordingly, the position of trajectory controller 124 relative to net 50 can be selectively varied.

Figure 4:
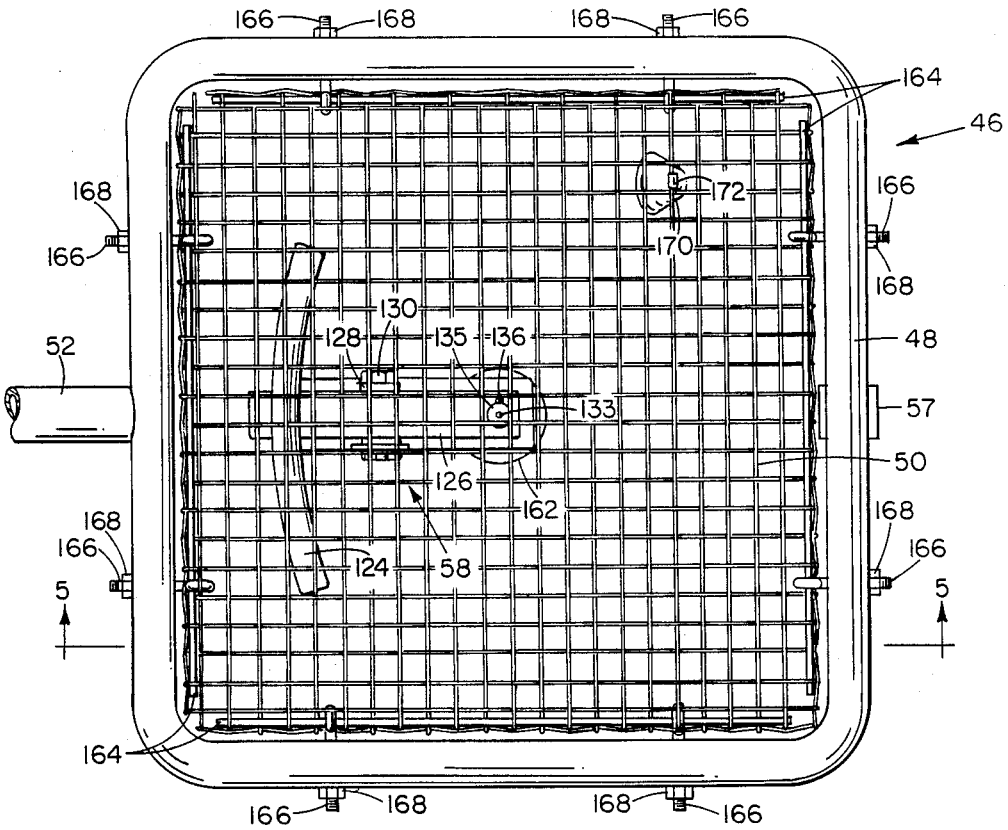
FIG. 4 is a top view of the preferred embodiment of the ball deflection apparatus of the present invention.

Referring to FIG. 4 and FIG. 5, the ball deflection apparatus 46 of the present invention will be described in greater detail. A plurality of cylindrical connection rods 164 are interwoven within the strands of net 50. Connection rods 164 are connected to frame 48 by means of a plurality of J-shaped bolts 166. Rods 164 are received within the hook portion or mouth of bolts 166 and the opposite ends of bolts 166 are inserted through passages in frame 48 and secured thereto by nuts 168. The tightening or loosening of nuts 168 permits the variable tensioning or tightening of net 50. As illustrated in FIG. 5, a bell 170 is preferably connected to net 50 by means of a metal strap 172 which is looped around net 50 and connected to bell 170. Bell 170 hangs below net 50 at an angle, as further illustrated in FIG. 5.

Figure 6:
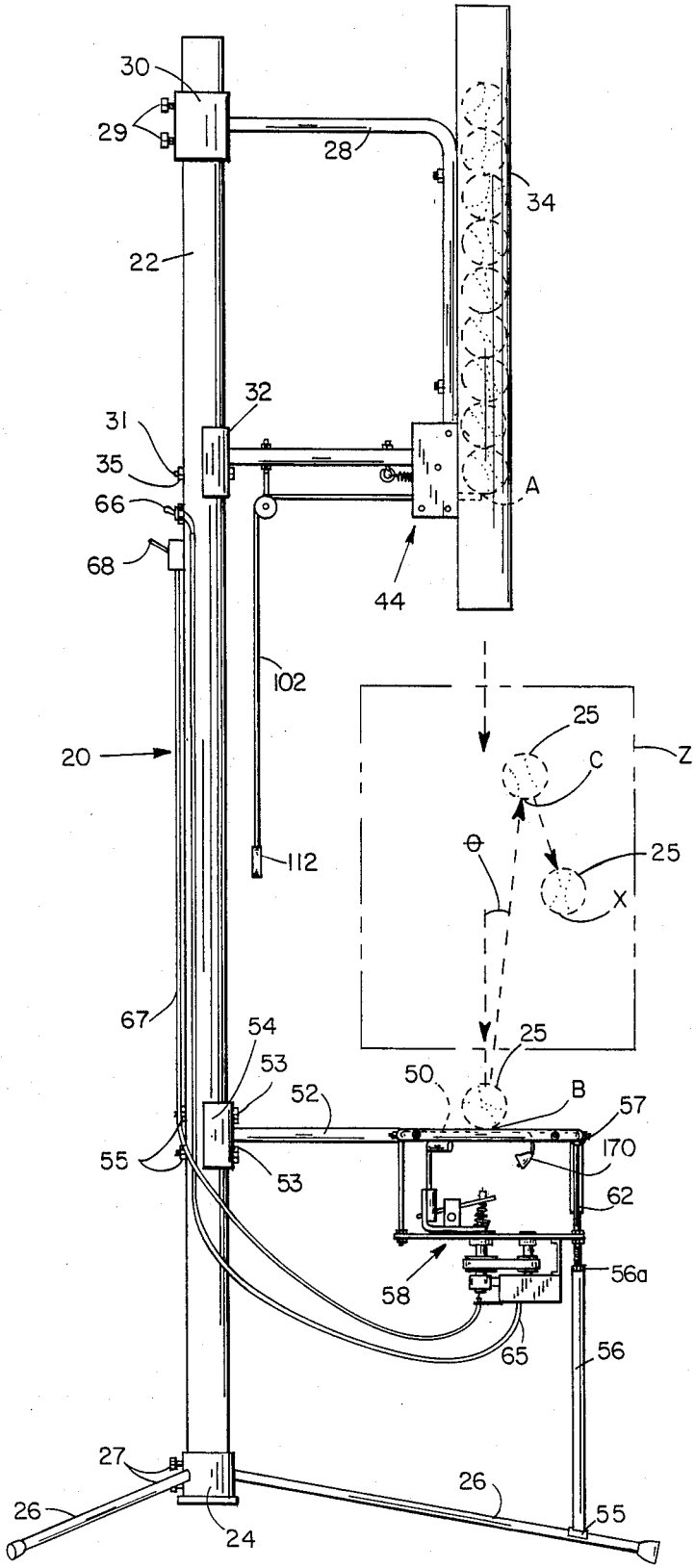
FIG. 6 is a side view of the preferred embodiment of the batting practice device of the present invention illustrating a sample ball trajectory.

Referring to FIG. 6, the operation of the batting practice device 20 will be described in greater detail. Prior to operation of the device 20, a right or left handed batter positions himself to the right of the device 20 illustrated in FIG. 6 so as to be able to swing a bat through the hitting zone Z in a plane substantially perpendicular to the plane of FIG. 6. Although the hitting zone Z will vary from batter to batter, it is generally located beneath magazine 34 and above net 50. The batter preferably stands in a normal batting stance and visualizes a pitcher in the windup process. A coach or other person thereafter adjusts the position of controller 124 by switch 66 and lever 68 and pulls downward on cable 102, thereby causing a lowermost ball 25 within magazine 34 to be released at point A. Ball 25 thereafter falls by gravity until it reaches and strikes net 50 at point B. When the ball 25 strikes net 50, bell 170 will ring, thereby giving the batter an auditory signal correspodding to the release of the ball 25 by the imagined pitcher. The batter thereafter initiates the "preparatory" or stride phase of his swing (with proper distribution of his weight) and shifts his attention to the hitting zone Z above the net 50 to visually locate the ball 25. After the ball 25 strikes net 50 it is deflected from point B to point C in accordance with the predetermined post deflection trajectory. During this time the batter waits to strike the ball 25. Point C corresponds to approximately the apex of the post deflection trajectory of ball 25 and is the point at which the batter should initiate the "swing" phase of the batting motor function. The batter preferably makes contact with the ball 25 at point X, the point to which ball 25 falls from point C. The position of trajectory controller 124 may thereafter be adjusted and the next successive ball 25 within magazine 34 may be released from magazine 34. The foregoing steps may be repeated until each ball 25 within magazine 34 has been released.

It is to be understood that the trajectory defined by the path between points A and B is referred to as the predeflection trajectory. Further, it is to be understood that the predeflection trajectory A-B illustrated in FIG. 6 is merely a sample predeflection trajectory and that the predeflection trajectory A-B can be varied by varying the distance between points A and B. This can be accomplished by varying the relative positions of magazine 34 and net 50. It is also to be understood that the trajectory defined by the path between points B and C is referred to as the post deflection trajectory. Further, it is to be understood that the post deflection trajectory B-C illustrated in FIG. 6 is merely a sample post deflection trajectory and that the post deflection trajectory B-C, including the angle $\theta$ between the substantially vertical predeflection trajectory A-B and the post deflection trajectory B-C, can be varied, as described in greater detail hereinbelow.

It is to be understood that the vertical component or vector of the post deflection trajectory B-C is defined by the height of the bounce or deflection of ball 25 (point C). Further, the height of point C, and thus, the time it takes the ball 25 to travel between points B and C, can be varied or ajusted by varying the distance between points A and B. For example, raising the height of magazine 34 relative to net 50 results in a higher deflection apex (point C), and, therefore, a "slower" pitch. It is also to be understood that the net 50 can be variably tightened or tensioned to thereby control the maximum height of the bounce or deflection (point C) of ball 25. Accordingly, the magnitude of the vertical vector of the post deflection trajectory B-C can be varied by varying or adjusting the relative positions of magazine 34 and net 50 and/or the tensions in net 50.

Figure 7:
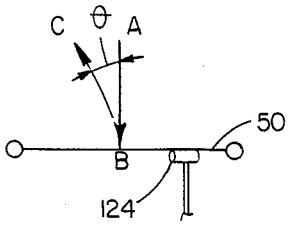
FIG. 7 is a schematic side view illustrating the post deflection ball trajectory relative to the position of the trajectory controller.
Figure 8:
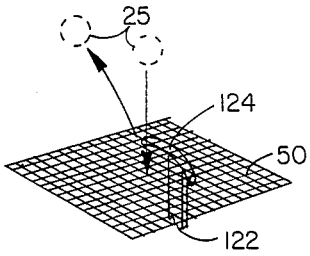
FIG. 8 is a schematic perspective view corresponding to FIG. 7 illustrating the post deflection ball trajectory relative to the position of the trajectory controller.
Figure 9:
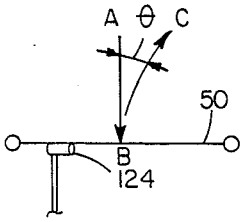
FIG. 9 is a schematic side view illustrating the post deflection ball trajectory relative to the position of the trajectory controller.
Figure 10:
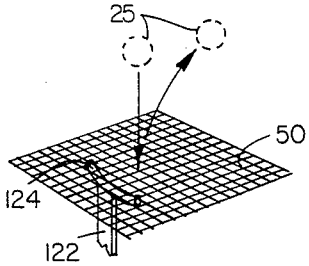
FIG. 10 is a schematic perspective view corresponding to FIG. 9 illustrating the post deflection ball trajectory relative to the position of the trajectory controller.
Figure 11:
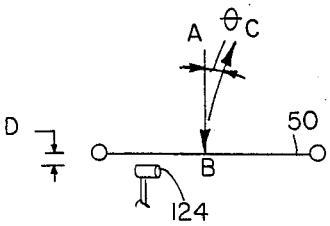
FIG. 11 is a schematic side view illustrating the post deflection ball trajectory relative to the position of the trajectory controller.
Figure 12:
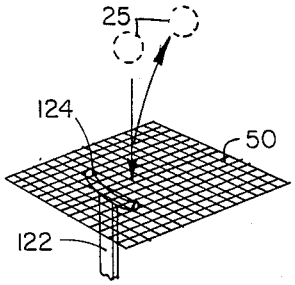
FIG. 12 is a schematic perspective view corresponding to FIG. 11 illustrating the post deflection ball trajectory relative to the position of the trajectory controller.

Referring to FIGS. 7–14, the variable control of the direction and angle of the post deflection trajectory B-C will be described in greater detail. As illustrated in FIG. 7 and FIG. 8, the trajectory controller 124 is on the right side of net 50 substantially adjacent to or in contact with the underside of net 50. Arrow or line segment A-B defines the predeflection trajectory of ball 25. Arrow or line segment B-C defines the post deflection trajectory of the ball 25. As illustrated in FIG. 7 and FIG. 8, controller 124 influences net 50 so that the direction of the post deflection trajectory B-C is away from the curve of member 124. As illustrated in FIG. 9 and FIG. 10, the member 124 is illustrated on the left side of net 50 substantially adjacent to or in contact with the underside of net 50. Once again, controller 124 influences net 50 so that the direction of the post deflection trajectory B-C illustrated in FIG. 9 and FIG. 10 is away from the curve of member 124. That is, if the post deflection trajectory B-C is influenced by controller 124 and is understood to have a vertical component or vector and a horizontal component or vector, the horizontal component or vector can be understood to be in approximately the same direction as a substantially straight line which passes from approximately the center of the arcuate member 124 and bisects at approximately a right angle a substantially straight line connecting the ends of the member 124. Accordingly, the variable positioning of member 124 beneath net 50 by the coach or other person operating device 20 permits the approximate direction or horizontal component of the post deflection trajectory B-C of ball 25 to be predetermined and selectively varied by rotating member 124 to a preselected position within the circular path of member 124.

Figure 13:
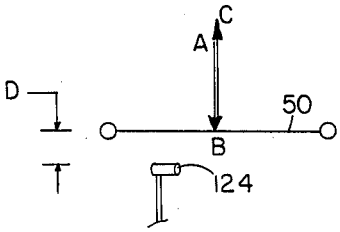
FIG. 13 is a schematic side view illustrating the post deflection ball trajectory relative to the position of the trajectory controller.
Figure 14:
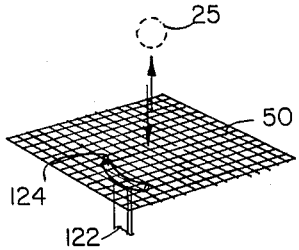
FIG. 14 is a schematic perspective view corresponding to FIG. 13 illustrating the post deflection ball trajectory relative to the position of the trajectory controller.

As further illustrated in FIG. 9 and FIG. 10, the height or position of member 124 relative to net 50 will determine the angle $\theta$ of the post deflection trajectory B-C. When ball 25 strikes net 50 at point B, net 50 will give slightly and may be influenced by controller 124, depending upon the position of controller 124 relative to net 50. Since there is little or no distance between controller 124 and net 50 in FIGS. 7–8 and FIGS. 9–10, controller 124 will influence net 50 upon deflection of ball 25 and the angle $\theta$ will be substantially identical in FIG. 7 and FIG. 9. As illustrated in FIGS. 9–14, the influence of member 124 on net 50 and corresponding angle of deflection $\theta$ will decrease as the distance D between net 50 and member 124 increases. That is, the angle $\theta$ is smaller in FIG. 11 than it is in FIG. 9. In fact, with the member 124 a substantial distance D away from net 50, as illustrated in FIG. 13 and FIG. 14, the influence of member 124 on net 50 and the post deflection trajectory B-C will be substantially eliminated, thereby allowing a substantially vertical post deflection trajectory B-C. Accordingly, the coach or other person operating device 20 can vary the angle $\theta$ of the post deflection trajectory B-C relative to the predeflection trajectory A-B by adjusting the distance D between net 50 and member 124 by means of lever 68. That is, the approximate angle $\theta$ of the post deflection trajectory B-C of ball 25 can be predetermined and selectively varied by raising or lowering member 124 to a preselected position relative to net 50.

It is to be understood that although the angle $\theta$ generally determines the magnitude of the horizontal vector of post deflection trajectory B-C, the degree of angle $\theta$ will also have some effect on the magnitude of the vertical vector of the post deflection trajectory B-C. That is, as $\theta$ becomes greater, the vertical height of point C will decrease. The angle $\theta$ will therefore effect the magnitude of both the horizontal component and the vertical component of the post deflection trajectory B-C. That is, as $\theta$ increases, the horizontal component increases and the vertical component decreases. As $\theta$ decreases, the horizontal component decreases and the vertical component increases. Further, as $\theta$ increases, the post deflection trajectory B-C becomes more curved. As $\theta$ decreases, the post deflection trajectory B-C becomes straighter.

In summary, utilization of the device 20 of the present invention allows a coach or other person to effectively "pitch" to a practicing batter. The speed of the pitch is generally controlled by adjusting the height of the magazine 34 relative to the net 50 and/or the tension in net 50. For example, if the time it takes a ball 25 to travel from point B to point C is approximately 0.5 seconds, this time approximates the time it takes for a ball thrown with an average velocity of approximately eighty (80) miles per hour to travel approximately sixty feet (60') from a pitcher's release point to a batter's hitting zone. The coach or other person is also able to selectively position the ball 25 within the batter's hitting zone Z without the batter's prior knowledge of the placement of the pitched ball 25 by selectively rotating and/or raising or lowering member 124. Further, imparting the appropriate post deflection trajectory B-C to ball 25, such as moving the ball 25 toward or away from the batter, will allow the batter to practice the skills associated with striking a "curve" ball. Finally, the ball 25 can be appropriately marked so that the coach can instruct the batter to "take" or not swing at the ball 25 if the mark is not seen, thereby allowing the batter to practice deciding whether to swing at a particular ball 25.

It is to be understood that arm 28 is preferably welded to sleeves 30 and 32. It is also to be understood that arm 52 is preferably welded to frame 48 and sleeve 54. Legs 26 are preferably welded to base 24. Further, motor 64 is preferably a 1/60 horsepower (hp) AC motor which may be connected to an appropriate power source (not shown) by means of a cord (not shown) wired into toggle switch 66. Motor 64 may also be replaced by a battery powered DC motor. Further, switch 66 preferably has a clockwise position, a neutral position, and a counterclockwise position. Motor 64 is preferably reduced down from approximately twenty four (24) revolutions per minute (rpm) to approximately four (4) revolutions per minute (rpm).

It is to be understood that magazine 34 is preferably adapted to hold ten (10) baseballs in substantially vertical alignment. It is also to be understood that the diameter of passage 36 is slightly larger than the diameter of ball 25 and that magazine 34 may be adapted to receive softballs or other types of balls of various sizes. Further, it is to be understood that the bottom discharge port of magazine 34 is preferably positioned over approximately the center of net 50. Finally, it is to be understood that device 20 may be readily assembled and disassembled to facilitate transportation thereof.

It is to be understood that post 22 is preferably a hollow post having a height of approximately eight feet (8'). Frame 48 is preferably a square with each side thereof having a length of approximately thirteen inches (13"). Magazine 34 is preferably PVC pipe having a length of approximately thirty inches (30"). The centers of magazine 34 and net 50 are approximately twenty two inches (22") away from post 22. Shafts 82 and 96 preferably have a diameter of approximately one quarter inch ($\frac{1}{4}$"). Arm 76 has a thickness of approximately three-eighths inches ($\frac{3}{8}$"). Belt 154 is preferably a rubber A type pulley belt. All of the various components of device 20, other than net 50, belt 154, magazine 34, and electrical cord 65, are metal.

It is to be understood that wire 133 passes through sheath 134, shaft 158, arm portion 115, spring 137, arm 126, and collar 135. It is also to be understood that the fact that eye bolt 80 may swivel slightly allows the angle between shaft 82 and arm 76 to vary. Further, the fact that eye bolt 94 may swivel slightly allows the angle between shaft 96 and arm 76 to vary. It is to be understood that the distance between point C, the point at which the batter initiates his swing, and point X, the point at which the batter makes contact with ball 25, is a function of the speed or quickness of the batter's swing. Finally, it is to be understood that it is envisioned that the device 20 may be computer controlled and operated.

While the batting practice device of the present invention has been described in connection with the preferred embodiment, it is not intended to limit the invention to the particular form set forth, but on the contrary, it is intended to cover such alternatives, modifications, and equivalent, as may be included within the spirit and scope of the invention as defined by the appended claims.

We claim:

1. Apparatus for selectively positioning a ball at different locations within a zone, comprising:

means for dropping said ball from a predetermined height, means for deflecting said ball; and horizontally and vertically movable means for cooperating with said ball deflection means, said means for cooperating with said ball deflection means being positioned beneath and movable independent of said ball deflection means so as to permit said means for cooperating with said ball deflection means to be variably positioned relative to said ball deflection means, said means for cooperating with said ball deflection means being adapted to variably influence said ball deflection means thereby to selectively position said deflected ball at said different locations within said zone.

2. Apparatus for selectively positioning a ball within a zone, as recited in claim 1, further comprising means for signaling deflection of said ball by said ball deflection means.

3. Apparatus for selectively positioning a ball within a zone, as recited in claim 1, wherein said means for deflecting a ball comprises a net connected to a frame.

4. Apparatus for selectively positioning a ball within a zone, as recited in claim 1, further comprising means for releasing said ball from a predetermined height.

5. Apparatus for selectively positioning a ball within a zone, as recited in claim 4, wherein said means for releasing said ball from a predetermined height comprises a magazine adapted to receive a plurality of balls and means for alternately abutting a lowermost one of said balls or a next lowermost one of said balls so that when said next lowermost ball is abutted said lowermost ball is released.

6. Apparatus for selectively positioning a ball within a zone, as recited in claim 1, wherein said means for cooperating with said ball deflection means comprises an arcuate member.

7. Apparatus for selectively positioning a ball at different locations within a zone, comprising:

means for deflecting said ball; and means for cooperating with said ball deflection means, said means for cooperating with said ball deflection means being adapted to variably influence said ball deflection means upon deflecton of said ball so as to selectively position said ball at different locations within said zone, said means for cooperating with said ball deflection means comprising an arcuate member located beneath said ball deflection means and means for variably positioning said arcuate member relative to said ball deflection means, said arcuate member having an arc of approximately one hundred thirty degrees.

8. Apparatus for selectively positioning a ball within a zone, comprising:

means for releasing said ball from a predetermined height;

means for deflecting said ball, said ball deflection means comprising a net connected to a frame; and an arcuate member for cooperating with said net, said arcuate member being positioned beneath and being movable independent of said net so as to be variably positioned relative to said net, said arcuate member being adapted to variably influence said net upon deflection of said ball so as to selectively position said ball at different locations within said zone.

9. Apparatus for selectively positioning a ball within a zone, as recited in claim 8, further comprising means for signaling deflection of said ball by said ball deflection means.

10. Apparatus for selectively positioning a ball within a zone, as recited in claim 8, wherein said means for releasing said ball from a predetermined height comprises a magazine adapted to receive a plurality of balls and means for alternately abutting a lowermost one of said balls or a next lowermost one of said balls so that when said next lowermost ball is abutted said lowermost ball is released.

11. Apparatus for selectively positioning a ball within a zone, as recited in claim 8, wherein said arcuate member has an arc of approximately one hundred thirty degrees.

12. A method for selectively positioning a ball at different locations within a zone, comprising the steps of:

positioning a controller member beneath means for deflecting said ball, said controller member selectively movable vertically and/or horizontally independent of said means for deflecting said ball so as to permit said controller member to be variably positioned relative to said means for deflecting said ball;

releasing said ball from a point above said ball deflection means; and deflecting said ball, said controller member influencing said ball deflection means upon deflection of said ball so as to selectively position said ball at said different locations within said zone.

13. A method for variably positioning a ball within a zone, as recited in claim 12, further comprising the step of simultaneously signaling deflection of said ball upon deflection of said ball.

* * * * *